United States Patent [19]

Hargassner et al.

[11] Patent Number: 4,562,876

[45] Date of Patent: Jan. 7, 1986

[54] APPARATUS FOR CONTINUOUS CASTING OF BARS OF DIFFERENT SIZES

[75] Inventors: Reinhard Hargassner; Alois Scheinecker, both of Linz, Austria

[73] Assignee: Voest-Alpine Aktiengesellschaft, Linz, Austria

[21] Appl. No.: 502,220

[22] Filed: Jun. 8, 1983

[30] Foreign Application Priority Data

Jun. 23, 1982 [AT] Austria ..... 2425/82

[51] Int. Cl.[4] ..... B22D 11/00

[52] U.S. Cl. ..... 164/459; 164/418; 164/420; 164/436; 164/491

[58] Field of Search ..... 164/420, 436, 443, 459, 164/483, 485, 491, 418

[56] References Cited

U.S. PATENT DOCUMENTS

| | | | |
|---|---|---|---|
| 3,682,235 | 8/1972 | Kazeef | 164/443 |
| 3,717,197 | 2/1973 | Strack et al. | 164/436 |
| 4,085,793 | 4/1978 | Scheinecker et al. | 164/436 |
| 4,210,197 | 7/1980 | Hargassner et al. | 164/416 |
| 4,223,717 | 9/1980 | Scheurecker | 164/459 |
| 4,270,593 | 6/1981 | Bachner | 164/436 |

FOREIGN PATENT DOCUMENTS

| | | | |
|---|---|---|---|
| 233187 | 9/1963 | Austria . | |
| 238387 | 2/1965 | Austria . | |
| 338449 | 8/1977 | Austria . | |
| 2948490 | 6/1981 | Fed. Rep. of Germany | 164/459 |
| 5097852 | 7/1980 | Japan | 164/436 |

*Primary Examiner*—Nicholas P. Godici
*Assistant Examiner*—Richard K. Seidel
*Attorney, Agent, or Firm*—Horst M. Kasper

[57] ABSTRACT

Additional intermediate narrow side walls are provided between narrow side walls at an apparatus for continuous casting of metals for casting as desired of metal bars with slab boom cross-section or of at least two metal bars of smaller cross-section, where a plate mold is employed, which is provided with a water tank supporting the narrow side walls and the wide side walls. In order to use best the cross-sectional area available for the forming of a slab bloom and in order to maintain acceptable and favorable viewing conditions immediately below the mold, the copper plates of the wide side walls between the end side narrow side walls are in each case subdivided by at least one recess in the longitudinal direction of the advancing metal bar in order to be able to cast at least two bars concurrently. The additional intermediate narrow side walls are inserted opposite to the narrow side walls into the recesses and the intermediate narrow side walls are in each case supported at the support constructions of the copper plates of the wide side walls disposed in the recesses.

22 Claims, 7 Drawing Figures

APPARATUS FOR CONTINUOUS CASTING OF BARS OF DIFFERENT SIZES

BACKGROUND OF THE INVENTION

1. Field of the Invention

The present invention relates to an apparatus for continuous casting of metal bars where the bar to be cast can have as desired the cross-section of a slab bloom or of at least two metal bars of smaller cross-section employing a plate mold, which is provided with a water tank supporting the narrow and wide side walls, where further narrow intermediate side walls are provided between the narrow side walls for the casting of at least two metal bars.

2. Brief Description of the Background of the Invention Including Prior Art

It is frequently desired to produce with one and the same apparatus for continuous casting, metal bars of different cross-sectional dimensions, where the mold form available for the largest metal bar cross-section is to be used advantageously also for smaller metal bar cross-section format sizes. An apparatus for this purpose is known for from Austrian Patent AT-PS No. 233,187, where one or more intermediate narrow side walls are inserted between the narrow side walls of a mold for one slab bloom size such that two or more side by side disposed metal bars of smaller cross-section can be simultaneously cast in a mold laid out for one slab bloom size. A problem arises however as to the attachment and to the supply with cooling medium of the narrow intermediate side walls clamped additionally between the wide side walls, which is not resolved in AT-PS No. 233,187.

An attachment for the additionally employed narrow intermediate side walls is known from German Patent Application Laid Out DE-AS No. 2,003,787, where a fixed intermediate wall is inserted between the wide side walls, which is attached to the wide side walls. Plates, which are adjustable in their inclination, are hinged to this fixed positioned intermediate wall.

The requirements regarding space are a disadvantage of this construction for the intermediate wall attached to the wide side walls, by which amount the useful cross-sections of the mold are decreased. A further disadvantage is that the adjustable attachment of the plates to the fixed position intermediate wall requires construction components, which protrude beyond the upper or, respectively, lower edge of the mold, such that on the one hand the upper covering of the mold has to be provided at a larger distance than is usual, which in turn degrades the viewing possibilities into the mold, and on the other hand guide rollers cannot be disposed adjoining immediately to the lower end of the mold, whereby the danger of bellying of the metal bar arises at high casting material throughput.

SUMMARY OF THE INVENTION

1. Purposes of the Invention

It is an object of the present invention to avoid the above set forth disadvantages and problems and to provide an apparatus for continuous casting of metal bars where in the case of smaller cross-section metal bars the cross-section available for slab bloom production is optimally employed.

It is another object of the present invention to provide an apparatus for continuous casting where the viewing possibilities into the mold and the guiding of the metal bar immediately below the mold are not degraded versus a mold for the casting of metal bars with slab bloom cross-section.

It is a further object of the present invention to provide a continuous casting apparatus and method where the molds for the smaller metal bars to be cast are substantially independent from each other.

These and other objects and advantages of the invention will become evident from the description which follows.

2. Brief Description of the Invention

The present invention provides an apparatus for the continuous casting of metal bars of standard and/or smaller sizes as selected, which comprises a water tank to provide cooling, a support construction attached to the water tank and to support the parts to provide a chilling surface to the metal bar extruded, copper plates at the wide side walls between narrow side walls and subdivided by a recess in the longitudinal direction of the strand, an intermediate narrow side wall disposed opposite to the narrow side wall and supported within the recesses at the support constructions of the copper walls at the wide side walls.

The intermediate narrow side walls can be supported in the lower end region in each case by joint bolts attached to the support construction of the copper plates, disposed in the area of the recesses and protruding into the intermediate narrow side walls and where in their upper end region brackets project from the side into the recesses and are fixed to the support constructions, and set screws can pass through brackets of the narrow intermediate side walls and can be fixedly attached to the support constructions. The narrow and wide side walls as well as the intermediate narrow side walls with their support constructions of the mold form at least for two metal bars a mold unit mountable to and demountable from the apparatus, which corresponds with regard to its dimensions on the outside and at the connections to a mountable and demountable mold unit for a metal bar with slab bloom cross-section.

The support constructions of the wide side walls in each case can be formed as one part from copper plates disposed aligned at one side and as extending over the full length of the copper plates disposed in aligned order. The support constructions of the wide side walls can be separated into two support construction parts in each case independent from each other by way of a recess. One part guide roller supports can be disposed below the intermediate narrow side walls. Guide rollers for the wide sides of the metal bars and disposed at the bottom side of the mold can be provided for two metal bars of smaller cross-section and rotatably supported at the guide roller supports and disposed at a height level between the guide rollers for the narrow sides of the metal bars. The intermediate narrow side walls at their upper region can be inserted by way of straps protruding to the side into grooves of the support construction corresponding to the straps.

There is also provided a method for continuous casting of metal bars of standard or smaller sizes which comprises providing a water tank to a metal extrusion apparatus, mounting a support structure onto the water tank to hold mold plates for the metal bar to be cast, attaching copper plates having a recess at their middle directed in the direction of the advance of the cast metal bar as wide side walls for the mold to the support construction together with a cooling medium connection to the water tank, mounting narrow side walls to the support construction to provide confinement for the cast metal bar, and setting into the recesses intermediate narrow side walls to provide more than one parallel mold for the continuous casting apparatus.

The intermediate side walls can be provided by separate sections independently mountable and demountable for each individual mold section. The narrow side intermediate walls can be supported in the lower end region in each case by joint bolts attached to the support construction of the copper plates, disposed in the area of the recesses and protruding into the narrow side intermediate walls. In their upper end region brackets can project from the side into the recesses and be fixed to the support constructions and set screws can pass through brackets of the intermediate narrow side walls and can be fixedly attached to the support constructions. The narrow and wide sides as well as the intermediate narrow side walls with their support constructions of the mold can form at least for two metal bars a mold unit mountable to and demountable from the apparatus, which corresponds with regard to its dimensions on the outside and at the connections to a mountable and demountable mold unit for a metal bar with slab bloom cross-section.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENTS

Figure 1:
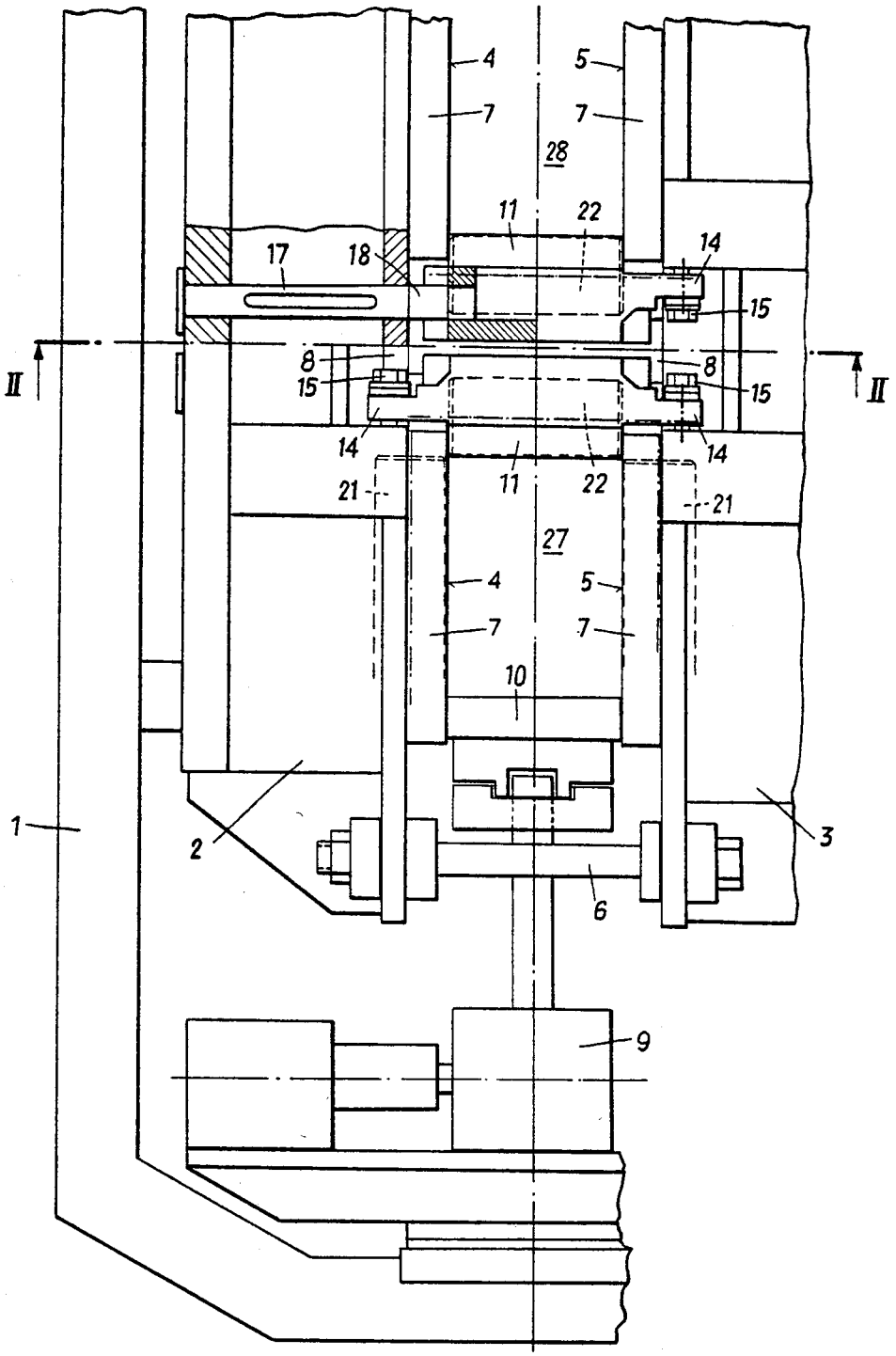
FIG. 1 is a plan view partially in section of a mold.

In accordance with the present invention there is provided an apparatus for continuous casting of metal bars selectable as to slab bloom cross-section or of at least two metal bars of smaller cross-section which comprises narrow side walls 10 of the mold supported by a water tank 1, wide side walls 4, 5 of the mold supported by the water tank 1 and comprising copper plates 7 parted in their shape by a recess 8 in the direction of the advancing metal bar, and intermediate narrow side walls 11 disposed between the narrow side walls 10 and inserted into the recesses 8 and disposed opposite to the narrow side walls 10 and the intermediate narrow side walls 11 are in each case supported at the support constructions 2, 3 of the copper plates 7 of the wide side walls 4, 5. The presence of additional intermediate narrow side walls 11 between the side walls 10 allows to produce at least two metal bars in parallel.

Flexible coupling conduits 18 preferably are disposed between the water tank 1 and the copper plates 7 to provide flow of cooling medium to the copper plates 7 of the wide side walls 4, 5. Intermediate narrow side walls 11 are supported in the lower end region in each case by joint bolts 12 attached to the support construction 2, 3 of the copper plates 7, disposed in the area of the recesses 8 and protruding into the intermediate narrow side walls 11 and where in their upper end region brackets 14 project from the side into the recesses 8 and are fixed to the support constructions 2,3 and set screws 15, 16 pass through brackets 14 of the intermediate narrow side walls 11 and are fixedly attached to the support constructions 2, 3. This allows adaptation of the inclination of the narrow side walls to the preset casting parameters.

In order to provide for simple redeployment of an apparatus or plant of slab boom dimensions to several metal bars of a smaller cross-sectional format, the wide side walls 4, 5 and the narrow side walls 10 as well as the intermediate narrow side walls 11 with their support constructions of the mold form a mountable and demountable construction unit for at least two metal bars of smaller cross-section. The construction unit for at least two metal bars corresponds with regard to its outer dimensions and its connecting dimensions to a mountable and demountable construction unit for slab bloom dimensions. In principle there exists the possibility of constructing the support constructions of the wide side walls together with the narrow side walls alone, however it is advantageous upon reconstructing the apparatus for continuous casting of metal bars to also exchange the water tank, that is in other words the water tank preferably constitutes part of the construction unit. The reconfiguring thereby can be performed in a particularly simple and rapid way, since only the water tank including the wide side walls and the narrow side walls supported by it are to be lifted off the lifting platform by way of a hoist or, respectively, are to be inserted into the lifting platform. The narrow and wide sides 10, 4, 5 as well as the intermediate narrow side walls 11 with their support constructions 2, 3 of the mold form at least for two metal bars a mold unit mountable to and demountable from the apparatus, which corresponds with regard to its dimensions on the outside and at the connections to a mountable and demountable mold unit for a metal bar with slab bloom cross-section.

Figure 2:
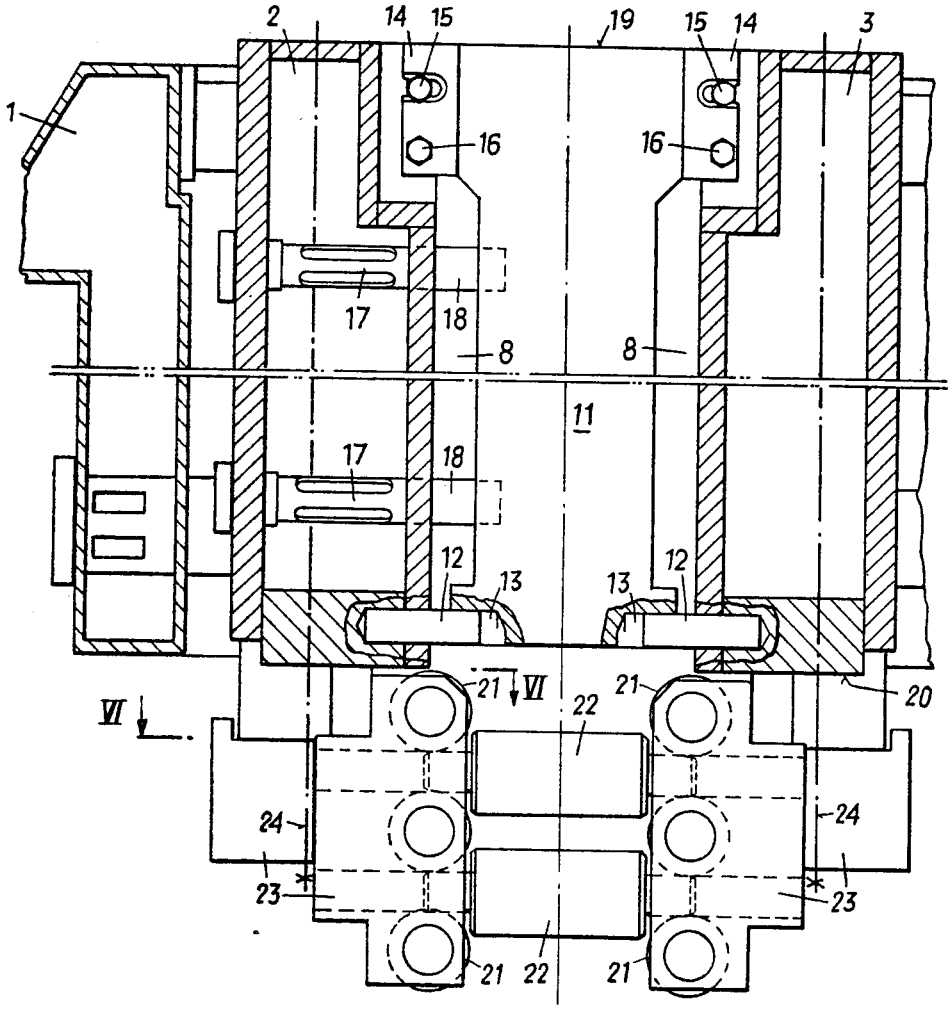
FIG. 2 is a sectional view along section line II—II of FIG. 1.

The support constructions 2, 3 of the wide side walls 4, 5 in each case are formed as one part from copper plates 7 disposed aligned at one side and as extending over the full length of the copper plates 7 disposed in aligned order as shown in FIGS. 1 and 2. This results in a particularly strong and sturdy construction.

Advantageously, the support constructions of the wide side walls are subdivided into two support construction parts in each case independent from each other by way of the recess, whereby it becomes possible to demount this part of the mold independent from the other parts upon failure of the mold part and to continue to cast the other metal bar or bars. Thus the support constructions 2, 3 in FIG. 5 of the wide side walls 4, 5 are preferably separated into two support construction parts 2', 2", 3', 3" in each case independent from each other by way of a recess 8.

It is possible to provide a particularly advantageous and space saving embodiment of the guide rollers disposed below the mold reconstructed for several metal bars. One-part guide roller supports 23 are disposed below the intermediate narrow side walls. Guide rollers 21 for the wide sides of the metal bars are disposed at the bottom side of the mold provided for two metal bars of smaller cross-section and are rotatably supported at the guide roller supports 23 and disposed at a height level between the guide rollers 22 for the narrow sides of the metal bars.

Figure 3:
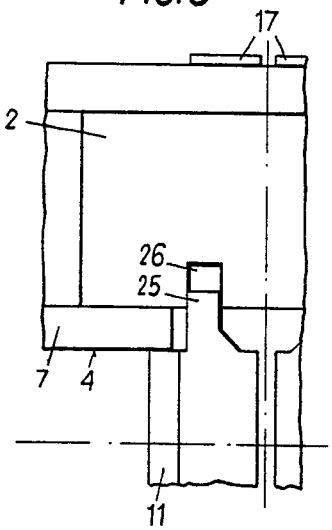
FIG. 3 shows a view of a further embodiment analogous to FIG. 1 in detail.
Figure 4:
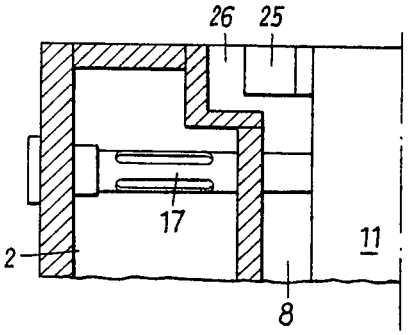
FIG. 4 is a view of the embodiment of FIG. 3 shown analogous to the view of FIG. 2.

A particularly simple embodiment is provided where the intermediate narrow side walls 11 at their upper region are inserted by way of straps 25 protruding to the side into grooves 26 of the support construction 2, 3 corresponding to the straps 25 as is shown in FIGS. 3, 4. The intermediate narrow side walls 11 are provided by separate sections independently mountable and demountable for each individual mold section.

In the following the invention is illustrated in more detail by way of the three embodiments shown in the Figs. A water tank 1 is placed on a lifting platform of a mold not shown here in detail. This water tank 1 is adapted as to its longitudinal extension to the largest castable metal bar cross-sectional dimension produceable at the apparatus for continuous casting. In order to be able to cast metal bars of smaller cross-section at the apparatus for metal casting, special support constructions 2, 3 for wide side walls 4, 5 are employed at the water tank 1, where one support construction 2 is supported by the water tank 1 and the second oppositely disposed support construction 3 is attached to the first support construction 2 by way of a bolt 6 and can be clamped and tensioned versus the first support construction 2.

The two support constructions 2, 3 in each case carry two copper plates 7 furnishing the wide side walls 4, 5, where the copper plates 7 disposed in each case at one support construction 2, 3 are separated from each other by a recess 8. The recesses 8 in part continue into the support constructions 2, 3.

Narrow side walls adjustable in a conventional manner by way of actuating drives 9 are clamped at the oppositely disposed ends of the support constructions 2, 3.

The recesses 8 serve to provide space for the attachment of two additional intermediate narrow side walls 11. They are supported within the recesses 8 against the support constructions 2, 3 of the wide side walls, and in fact each intermediate narrow side wall 11 is supported at its lower end region by way of joint bolts 12 attached to the support constructions 2, 3 and disposed in the range of the recesses 8. The joint bolts 12 protrude downwardly into open U-shaped recesses 13 of each narrow intermediate side wall 11. Bracket plates 14 are provided at the upper end region of the narrow intermediate side walls 11, which bracket plates protrude to the side into the recesses 8 and are fixed by way of set screws 15 and counterscrews 16 to the support constructions 2, 3 in each case. Different inclinations of the intermediate narrow side walls 11 can be adjusted by way of the set screws 15 and counter set screws 16 for adaptation to different casting parameters.

The intermediate narrow side walls are provided with cooling water via plug tubes 17 passing through the water tank 1, which plug tubes protrude in each case with one end into the interior of the intermediate narrow side walls 11. The plug tubes 17 are provided with flexible connection pieces 18 in order to provide for changes in inclination of the intermediate narrow side walls 11.

Figure 6:
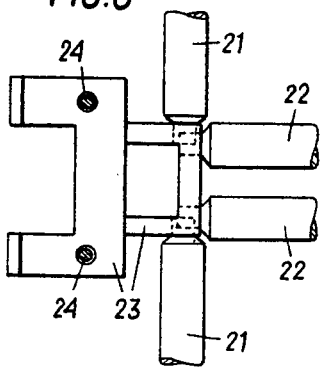
FIG. 6 is a view of a guide roller support along section line VI—VI of FIG. 2.

As can be recognized in particular from FIG. 2, the mold is not provided with any attachment elements for the narrow intermediate side walls 11 disposed above the upper edges 19 of the wide side walls 4, 5 and below the lower edges 20 of the wide side walls, which renders it possible on the one hand to provide guide rollers immediately below the mold. A particularly advantageous disposition of the guide rollers 22 results here if the narrow side of the guide rollers 22 supporting the narrow side of the metal bar are provided at a height level about middle between the guide rollers 21, supporting the wide sides of the metal bar. The guide roller support 23 receiving the guide rollers 21, 22 is formed as one piece as shown in FIG. 6. The guide roller support is attached to the support constructions 2, 3 by way of screws 24 protruding up to the top side of the support constructions 2, 3.

The narrow and wide side walls 4, 5, 10, 11 together with the water tank surrounding them provide a construction unit, which can be mounted to and demounted from the mold and which with regard to its outer dimensions and to its connection sizes for the cooling medium supply lines corresponds to a construction unit, which can be mounted and demounted for a metal bar with slab boom cross-section.

According to the embodiment shown in FIGS. 3 and 4, the additional intermediate narrow side walls are furnished in their upper region with straps 25 protruding outwardly on the side into the recesses 8, where the straps 25 are inserted into corresponding grooves 26 of the support constructions 2, 3. In the context of this particularly simple embodiment the inclination angle of the additional intermediate narrow side walls cannot be adjusted. The intermediate narrow side walls are supported in their lower end region as is illustrated in FIGS. 1 and 2.

Figure 5:
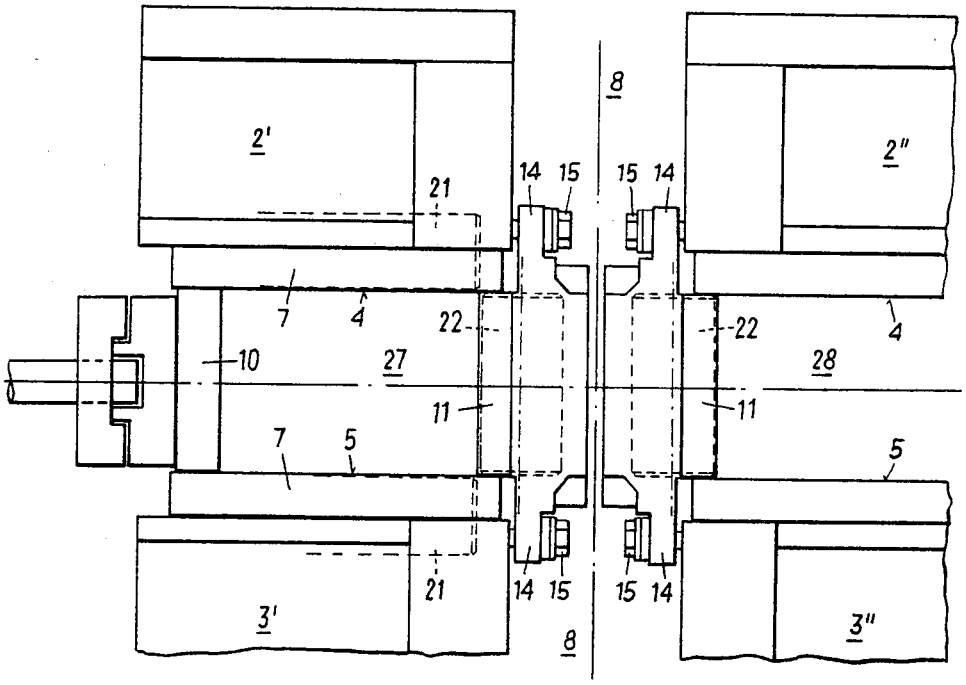
FIG. 5 is a view of a further embodiment shown in a view analogous to that of FIG. 1.

The recesses 8 are provided of such dimensions according to the embodiment of FIG. 5 that the support constructions 2, 3 of each of the wide side walls 4, 5 is subdivided into two. Each part 2', 2", 3', 3" of the support construction 2, 3 is separately supported at the water tank 1. This results in the advantage, that in case of a failure of a side wall 4, 5, 10, 11 of one mold hollow space 27, 28 casting can be continued in the other mold hollow space and the defective part of the mold can in the meantime be demounted and repaired.

It will be understood that each of the elements described above, or two or more together, may also find a useful application in other types of continuous casting system configurations and procedures for adapting large molds to smaller products differing from the types described above.

While the invention has been illustrated and described as embodied in the context of a storage tank for liquefied gases, it is not intended to be limited to the details shown, since various modifications and structural changes may be made without departing in any way from the spirit of the present invention. For example, it is possible to obtain more than two hollow mold spaces 27, 28 by providing two or more recesses 8 for each wide side wall 4, 5.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Apparatus for selective continuous casting of either a metal bar of slab bloom cross-section or of at least two metal bars of smaller cross-section having interchangeably mounted first and second mold unit wherein the first mold units for casting said at least two metal bars of smaller cross-section comprises a water tank;

narrow side walls of the mold supported by the water tank;

wide side walls of the mold supported by the water tank and comprising copper plates separated in their shape by a recess in the direction of the advancing metal bar, and intermediate narrow side walls disposed between the narrow side walls and having surfaces disposed opposite to the narrow side walls and where the intermediate narrow side walls are in each case inserted into the recesses and are supported within the recesses by the support constructions of the copper plates of the wide side walls.

2. The apparatus for continuous casting of metal bars according to claim 1 wherein the intermediate narrow side walls are supported in the lower end region in each case by joint bolts attached to the support construction of the copper plates, disposed in the area of the recesses and protruding into the intermediate narrow side walls and where in their upper end region brackets project from the side into the recesses and are fixed to the support constructions and set screws pass through brackets of the narrow intermediate side walls and are fixedly attached to the support constructions.

3. The apparatus for continuous casting of metal bars according to claim 1 wherein said mold unit is mountable to and demountable from the apparatus and corresponds with regard to its dimensions on the outside and at the connections to said mountable and demountable second mold unit for a metal bar with slab bloom cross-section.

4. The apparatus for continuous casting of metal bars according to claim 1 wherein the support constructions of the wide side walls of said second unit in each case are formed as one part with copper plates disposed aligned at one side of a side wall and with the support constructions extending over the full length of the copper plates disposed in aligned order relative to the side walls.

5. The apparatus for continuous casting of metal bars according to claim 1 wherein the support constructions of the wide side walls of said second unit are separated into two support construction parts in each case independent from each other by way of a recess.

6. The apparatus for continuous casting of metal bars according to claim 1 further comprising one part guide roller supports disposed below the narrow said intermediate walls; and guide rollers for the wide sides of the metal bars and disposed at the bottom side of the mold provided for two metal bars of smaller cross-section and rotatably supported at the guide roller supports and disposed at a height level between the guide rollers for the narrow sides of the metal bars.

7. The apparatus for continuous casting of metal bars according to claim 1 wherein the intermediate narrow side walls at their upper region are inserted by way of straps protruding to the side into grooves of the support construction corresponding to the straps.

8. An apparatus for the continuous casting of metal bars of varying sizes as selected based on interchangeably mounted mold units wherein a first mold unit for casting at least two metal bars of smaller cross-section comprises a water tank to provide cooling;

a support construction attached to the water tank and to support the parts to provide a chilling surface to the metal bar extruded;

narrow side walls and wide side walls;

copper plates at the wide side walls adjoining said narrow side walls and subdivided by a recess in the longitudinal direction of the strand;

an intermediate narrow side wall disposed opposite to the narrow side wall and supported within the recesses at the support constructions of the copper walls at the wide side walls.

9. The apparatus for continuous casting of metal bars according to claim 8 further comprising flexible coupling conduits disposed between the water tank and the copper plates to provide flow of cooling medium to the copper plates of the wide side walls.

10. The apparatus for continuous casting of metal bars according to claim 8 wherein the narrow side intermediate walls are supported in the lower end region in each case by joint bolts attached to the support construction of the copper plates, disposed in the area of the recesses and protruding into the intermediate narrow side walls and where in their upper end region brackets project from the side into the recesses and are fixed to the support constructions and set screws pass through brackets of the narrow intermediate side walls and are fixedly attached to the support constructions.

11. The apparatus for continuous casting of metal bars according to claim 8 wherein said first mold unit is mountable to and demountable from the apparatus, and corresponds with regard to its dimensions on the outside and at the connections to a mountable and demountable second mold unit for a metal bar with slab bloom cross-section and which is to be interchanged for the mold unit without intermediate side walls of a second unit in case a metal bar with slab-bloom cross-section is to be cast.

12. The apparatus for continuous casting of metal bars according to claim 8 wherein the support constructions of the wide side walls in each case are formed as one part with copper plates disposed aligned at one side of a side wall and with the support constructions extending over the full length of the copper plates disposed in aligned order relative to the side walls.

13. The apparatus for continuous casting of metal bars according to claim 8 wherein the support constructions of the wide side walls are separated into two support construction parts in each case independent from each other by way of a recess.

14. The apparatus for continuous casting of metal bars according to claim 8 further comprising one-part guide roller supports disposed below the intermediate narrow side walls; and guide rollers for the wide sides of the metal bars and disposed at the bottom side of the mold provided for two metal bars of smaller cross-section and rotatably supported at the guide roller supports and disposed at a height level between the guide rollers for the narrow sides of the metal bars.

15. The apparatus for continuous casting of metal bars according to claim 8 wherein the intermediate narrow side walls at their upper region are inserted by way of straps protruding to the side into grooves of the support construction corresponding to the straps.

16. The method for continuous casting of metal bars according to claim 8 wherein the intermediate side walls are provided from separate sections independently mountable and demountable for each individual mold section.

17. A method for continuous casting of metal bars of standard or smaller sizes comprising providing a first mold unit where metal slabs are to be cast including:

mounting a support structure onto the water tank to hold mold plates for the metal slab to be cast, attaching copper plates as wide side walls for the mold to the support construction together with a cooling medium connection to the water tank, mounting narrow side walls to the support construction to provide confinement for the cast metal slab;

providing a second mold unit where at least two metal bars of smaller cross-section are to be cast including:

mounting a support structure onto the water tank to hold mold plates for the metal bar to be cast, attaching copper plates having a recess at their middle directed in the direction of the advance of the cast metal bar as wide side walls for the mold to the support construction together with a cooling medium connection to the water tank for casting at least two metal bars of smaller size, mounting narrow side walls to the support construction to provide confinement for the cast metal bar;

setting into the recesses intermediate narrow side walls to provide more than one parallel mold for the continuous casting apparatus;

installing the mold unit selected; and feeding hot metal to the mold to provide a continuous casting.

18. The method for continuous casting of metal bars according to claim 17 wherein the intermediate side walls are provided from separate sections independently mountable and demountable for each individual mold section.

19. The method for continuous casting of metal bars according to claim 17 further comprising supporting the intermediate narrow side walls in the lower end region in each case by joint bolts attached to the support construction of the copper plates, where the intermediate narrow side walls are disposed in the area of the recesses and protrude into the intermediate narrow side walls and where brackets project from the side in the upper end region of the intermediate narrow side walls into the recesses and are fixed to the support constructions and set screws pass through brackets of the narrow intermediate side walls and are fixedly attached to the support constructions.

20. The method for continuous casting of metal bars according to claim 17 wherein the second mold unit is mountable to and demountable from the apparatus, and corresponds with regard to its dimensions on the outside and at the connections to the mountable and demountable first mold unit for a metal bar with slab bloom cross-section.

21. Apparatus for continuous casting of metal bars selectable as to slab bloom cross-section or of at least two metal bars of smaller cross-section comprising an interchangeable mold unit for casting metal bars with slab bloom cross-section including:

a water tank, narrow side walls of the mold supported by the water tank;

wide side walls for the mold supported by the water tank and comprising copper plates; and an interchangeable mold unit for casting at least two metal bars of relatively smaller cross-section including:

a water tank, narrow side walls of the mold supported by the water tank; wide side walls of the mold supported by the water tank and comprising copper plates separated in their shape by a recess in the direction of the advancing metal bar, and intermediate narrow side walls disposed between the narrow side walls and having surfaces disposed opposite to the narrow side walls and where the intermediate narrow side walls are in each case inserted into the recesses and are supported within the recesses by the support constructions of the copper plates of the wide side walls.

22. An apparatus for the continuous casting of metals bars of varying sizes as selected comprising in the case where it is selected to cast a single slab an interchangeably mounted mold unit including:

a water tank to provide cooling, a support construction attached to the water tank and to support the parts to provide a chilling surface to the metal bar extruded; and in the case where it is selected to cast at least two metal bars of smaller cross-section an interchangeably mounted mold unit including:

a water tank to provide cooling, a support construction attached to the water tank and to support the parts to provide a chilling surface to the metal bar extruded, copper plates at the wide side walls adjoining narrow side walls and subdivided by a recess in the longitudinal direction of the strand, an intermediate narrow side wall disposed opposite to the narrow side wall and supported within the recesses at the support constructions of the copper walls at the wide side walls.

* * * * *

UNITED STATES PATENT AND TRADEMARK OFFICE

CERTIFICATE OF CORRECTION

PATENT NO. : 4,562,876

DATED : January 7, 1986

INVENTOR(S) : Reinhard Hargassner et al

It is certified that error appears in the above-identified patent and that said Letters Patent is hereby corrected as shown below:

Claim 3, line 2, after "said" insert -- first --.

Claim 4, line 3, delete "second" and substitute therefor -- first --.

Claim 11, lines 9 and 10, delete "of a second unit".

Claim 12, line 3 after "walls" insert -- of a second unit --.

Figure 7:
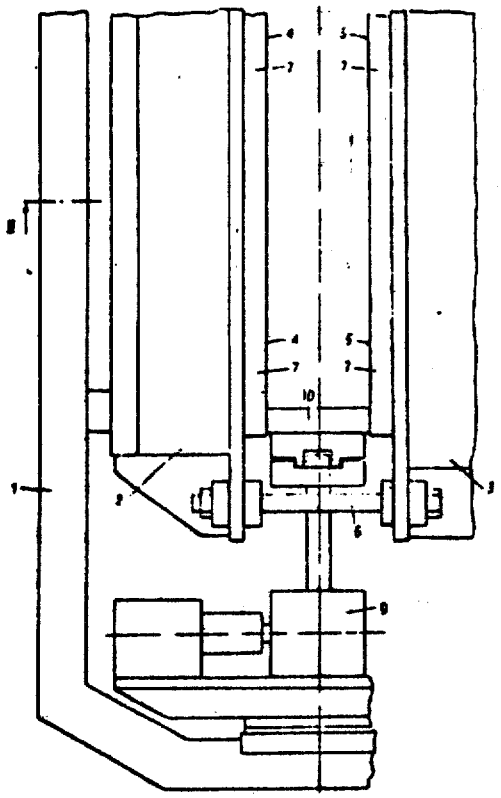
FIG. 7 is a plan view partially in section like FIG. 1, however without the partitioning intermediate side walls.

Insert Fig. 7 as shown on the attached sheet.

Signed and Sealed this

*Sixteenth* Day of *September 1986*

[SEAL]

*Attest:*

*Attesting Officer*

DONALD J. QUIGG

*Commissioner of Patents and Trademarks*